US005701958A

United States Patent [19]

Braziel

[11] Patent Number: 5,701,958

[45] Date of Patent: Dec. 30, 1997

[54] APPARATUS FOR DRILLING PERFORATIONS IN WELL CASINGS

[76] Inventor: Tom E. Braziel, P.O. Box 458, La Luz, N. Mex. 88337

[21] Appl. No.: 575,638

[22] Filed: Dec. 20, 1995

[51] Int. Cl.[6] ..... E21B 43/11

[52] U.S. Cl. ..... 166/298; 166/55.2

[58] Field of Search ..... 166/55, 55.2, 297, 166/298

[56] References Cited

U.S. PATENT DOCUMENTS

| | | | |
|---|---|---|---|
| 1,693,013 | 11/1928 | Young et al. | 166/55.2 X |
| 2,066,409 | 1/1937 | Loring et al. | 166/55.2 |
| 4,119,148 | 10/1978 | Deardorf | 166/55.2 X |
| 5,183,111 | 2/1993 | Schellstede | 166/55.2 X |
| 5,286,144 | 2/1994 | Griner | 166/55.2 X |

*Primary Examiner*—Roger J. Schoeppel

*Attorney, Agent, or Firm*—Herbert J. Hammond; Peter J. Thoma; Daniel J. Chalker

[57] ABSTRACT

Apparatus for drilling perforations in a well casing to reinitiate water flow into the casing to restore operation of a well. The apparatus includes a pneumatic drill mounted within a housing which is capable of being lowered into a well casing. The drill is moveable by remote control between a rest position and a working position within the housing to cause a drill bit to pass through a port in the housing to drill perforations at selected locations in the well casing.

7 Claims, 5 Drawing Sheets

APPARATUS FOR DRILLING PERFORATIONS IN WELL CASINGS

BACKGROUND OF THE INVENTION

The present invention relates to well repair devices and more particularly to devices for down-well repair work in a well casing to restore operation of the well.

Modern water wells use polyvinyl chloride ("PVC") casings to facilitate pumping operations and to prevent the collapse and contamination of the well. After a well is drilled, but before a casing is inserted into the well, holes are drilled in one or more segments of the casing. Once the casing is inserted into the well, these holes act as water access perforations to allow water to flow from the surrounding strata into the casing. The water can then be pumped to the surface.

At any time during the life of the well, the water supply to the pump may be interrupted. These interruptions can be caused by an insufficient number of water access perforations in the casing, sediment plugging the perforations, or a change in the water level. In the past, when any of these problems occurred, it has been the practice to remove the entire length of well casing for repair. After new perforations are drilled in the casing, it is reinserted into the well. The only other alternative is to abandon the existing well and drill a new well, which can take several days.

Both of the aforementioned corrective procedures are time consuming and costly. In addition, the interruption of water flow from the well can cause injury to crops and livestock. There is, accordingly, a need for a more effective technique for restoring operation of a well which has ceased operation due to any of the aforementioned causes.

SUMMARY OF THE INVENTION

In accordance with the present invention, an apparatus is provided for drilling perforations in a well casing, while in place in a well, to restore useful operation of the well. The apparatus includes a drill assembly which can be lowered into the well casing and selectively positioned at various depths in the well. When in a desired position, the drill assembly can be operated under remote control to drill a hole in the well casing. The drill assembly can be repeatedly repositioned to drill a plurality of holes at desired locations to thereby revitalize fluid flow into the well casing from the surrounding strata.

The presently preferred way of carrying out the invention is described in detail below with reference to the accompanying drawings.

DESCRIPTION OF THE PREFERRED EMBODIMENTS

Figure 1:
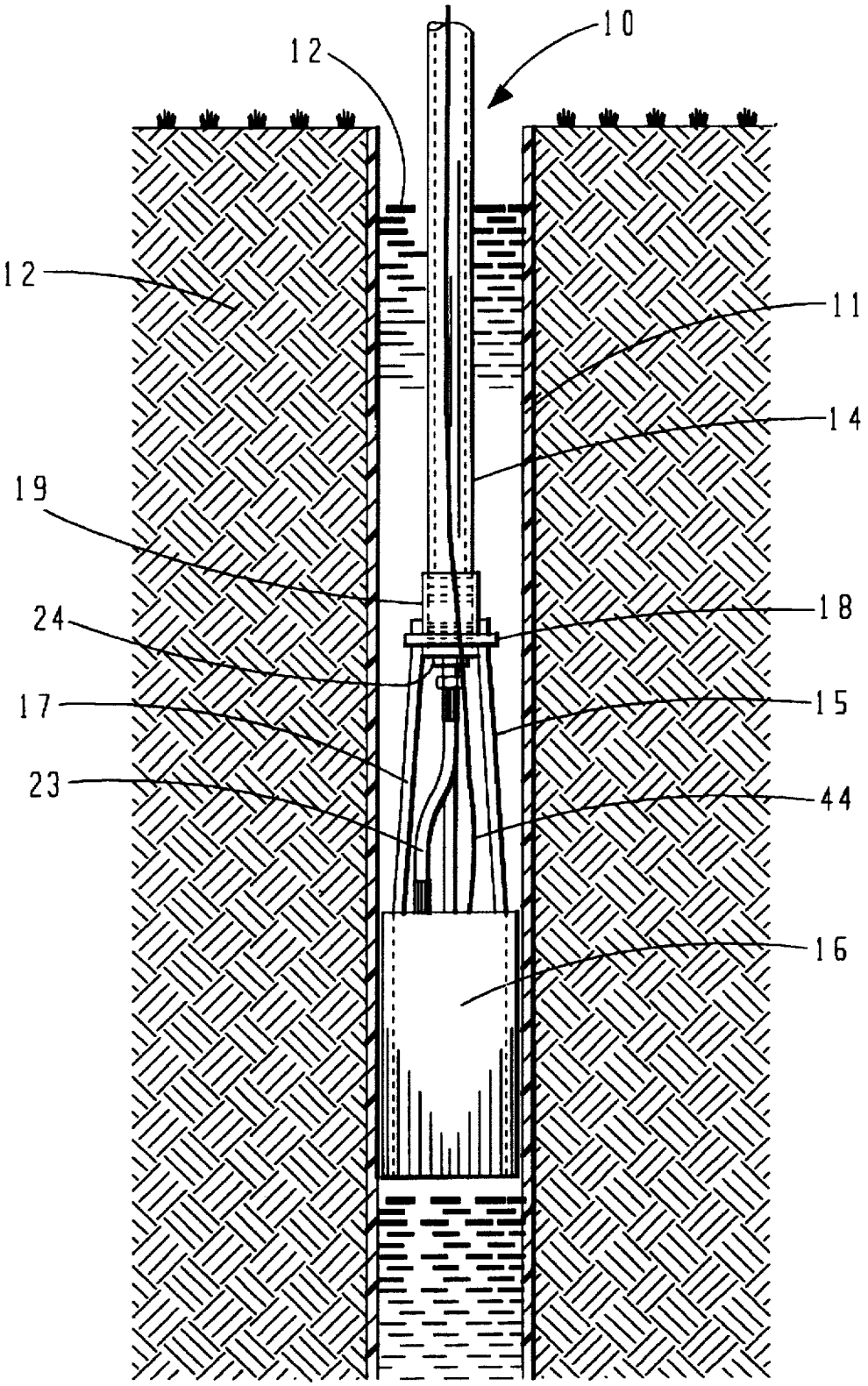
FIG. 1 is a vertical cross section through a typical water well casing and surrounding earth strata with a perforator of the invention disposed therein.

Referring to FIG. 1, a preferred drilling apparatus or perforator is indicated generally by reference numeral 10. The perforator 10 is shown extending down a well casing 11 of a conventional water well. A typical well may be 200 to 600 feet deep. The well casing 11 is typically a PVC tube which is installed in the original well when drilled. Such PVC tubes come in various sizes, the most common for use in water wells having segments or joints of 5 inches in diameter and 20 feet in length. The well casing 11 is originally installed with perforations (not shown) in the one or more segments to permit water 12 to flow into the casing from the surrounding strata 13. When the original perforations become clogged, the inventive apparatus may be employed to restore water flow into the casing.

The perforator 10 is transported down into the well casing 11 using a rigid tube 14, preferably 1¼" diameter PVC tubing. The perforator 10 is designed to operate while submerged in water, and thus has a down-well assembly 15 of an open construction to allow water to pass therethrough. The assembly 15 includes a housing 16, which is preferably cylindrical and has a smooth outer surface such that the well casing 11 is not damaged when the perforator 10 is moved up and down therein. The assembly 15 also includes support rods 17 connecting the housing 16 to a plate 18. An internally threaded sleeve 19 is secured to the plate 18. The lower end of the tubing 14 is threaded to mate with the sleeve 19, thus providing a rigidly interconnected assembly for down-well drilling of perforations.

Figure 2:
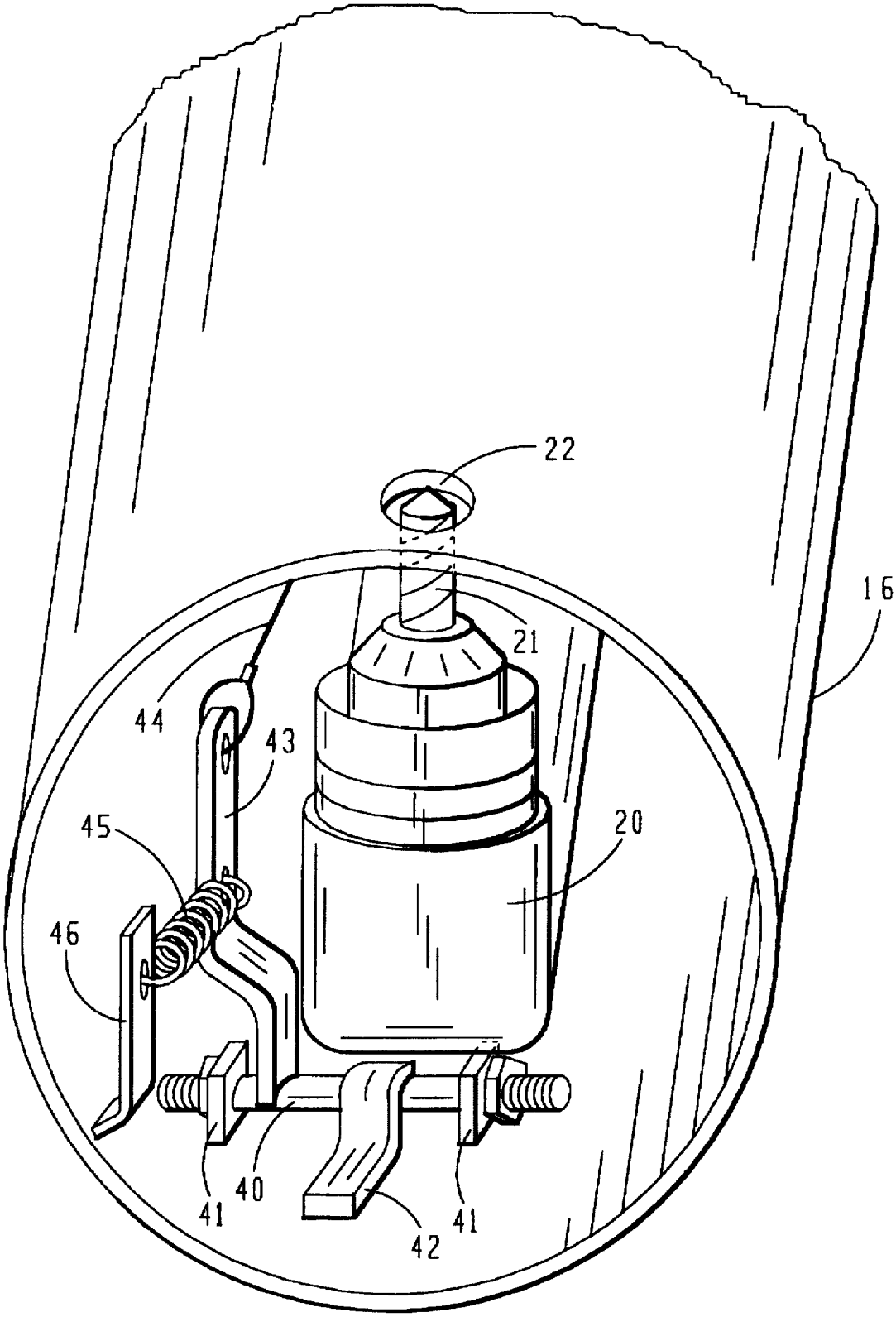
FIG. 2 is a perspective view of a drill and a portion of a surrounding cylindrical housing in accordance with a preferred embodiment of the invention.

Briefly referring to FIG. 2, a right-angle, pneumatic drill 20 is mounted inside the housing 16, and is driven by a compressed air source (not shown) provided outside the well above the earth's surface. Various suitable pneumatic drills are commercially available, the type CP879 sold by Chicago Pneumatic being an example. Similar suitable pneumatic drills are sold by the Ingersol-Rand Company. As described in detail below, the drill 20 is moveable under the remote control of an operator above the earth's surface to force a drill bit 21 through a port 22 in the wall of the housing 16. The port 22 may be a circular hole or an elongated slot. A ½" diameter hole is sufficiently large to permit a ¼" drill bit 32 to pass through without interference. By causing the drill bit 21 to extend through the port 22, the operator drills a hole or perforation in the well casing in accordance with the invention. The housing 16 is preferably 9-⅞" long, having a 4-15/16" O.D. (outside diameter) and 4-¾" I.D. (inside diameter), which is appropriately sized for use in a 5" I.D. well casing.

Referring again to FIG. 1, the support rods 17 are preferably ⅜" in diameter and 14" long, each having one end welded to the top of the housing 16 and the other end welded to the plate 18. The housing 16, support rods 17 and plate 18 are preferably steel, thus providing a rigidly interconnected assembly, which is rugged and resists rusting.

The length of the support rods 17 is designed to accommodate a standard length of high pressure tubing 23. The tubing 23 is connected at one end to the drill and at the other end to a coupling 24, which is secured to the bottom of the plate 18. If the sleeve 19 is metal, it can be welded to the top of the plate 18. Alternatively, the sleeve 19 can be secured to the plate 18 by a threaded connection with the coupling 24. A standard reduction coupling may be used in which the coupling 24 has exterior threads which mate with the 1-¼" I.D. sleeve 19 and the ⅝" I.D. fittings of the high pressure tubing 23.

In the preferred embodiment, the PVC tube 14 serves both as a device for raising and lowering the assembly 15 in the well easing 11, and as a device for passing compressed air from a compressor (not shown) above the well into the pneumatic tubing 23 and the drill 20.

Figure 3:
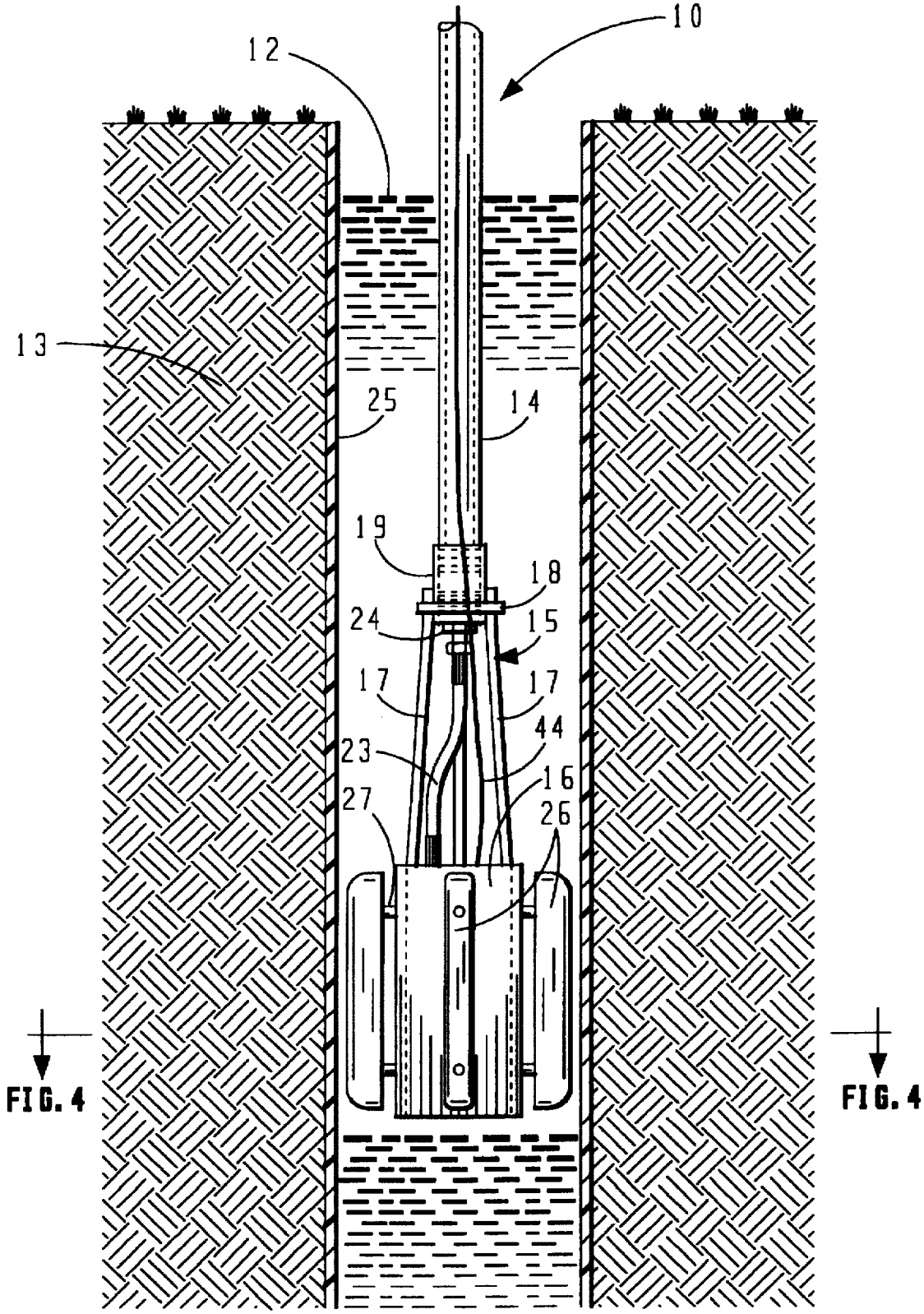
FIG. 3 is a vertical cross section through another, water well casing and surrounding earth strata with an alternative embodiment of a perforator disposed therein in accordance with the invention.
Figure 4:
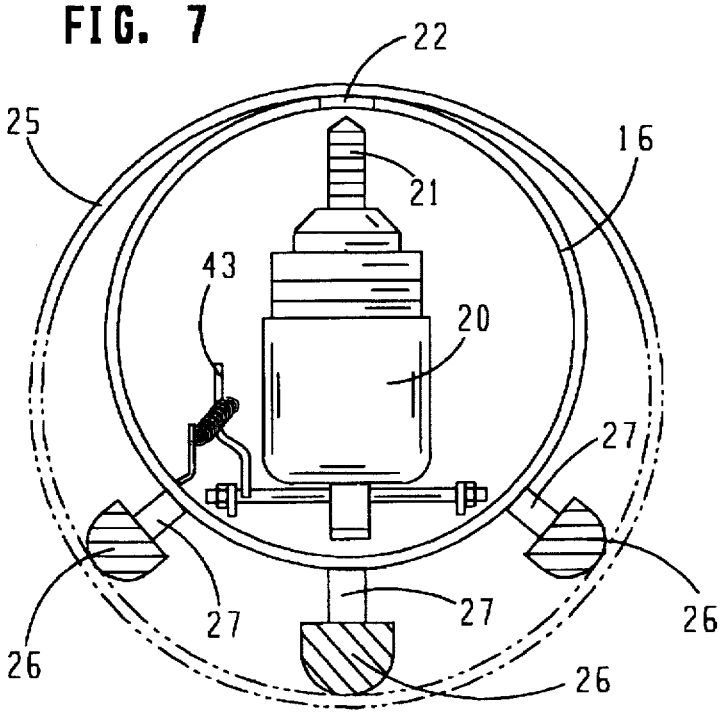
FIG. 4 is a schematic cross section of a portion of the alternative perforator of FIG. 3.

Now referring to FIGS. 3 and 4, an alternate embodiment of the invention will be described, with previously used numerals referring to the same or similar parts. In order to adapt the perforator 10 for use in a larger well casing 25, a plurality of elongated buffers 26 are secured to the housing 16. By way of example, three such buffers 26 are shown, each being secured to the outside of the housing 16 by posts 27, which may be fastened by means of threaded holes (not shown) in the housing 16. As seen in FIG. 4, the buffers 26 serve to hold the housing 16 against the interior of the well casing 25 in position such that the drill port 22 is adjacent the well casing 25. Thus, the drill 20 can be operated in essentially the same manner as in the principal embodiment to cause the drill bit 21 to make perforations in the well casing 25.

Figure 5:
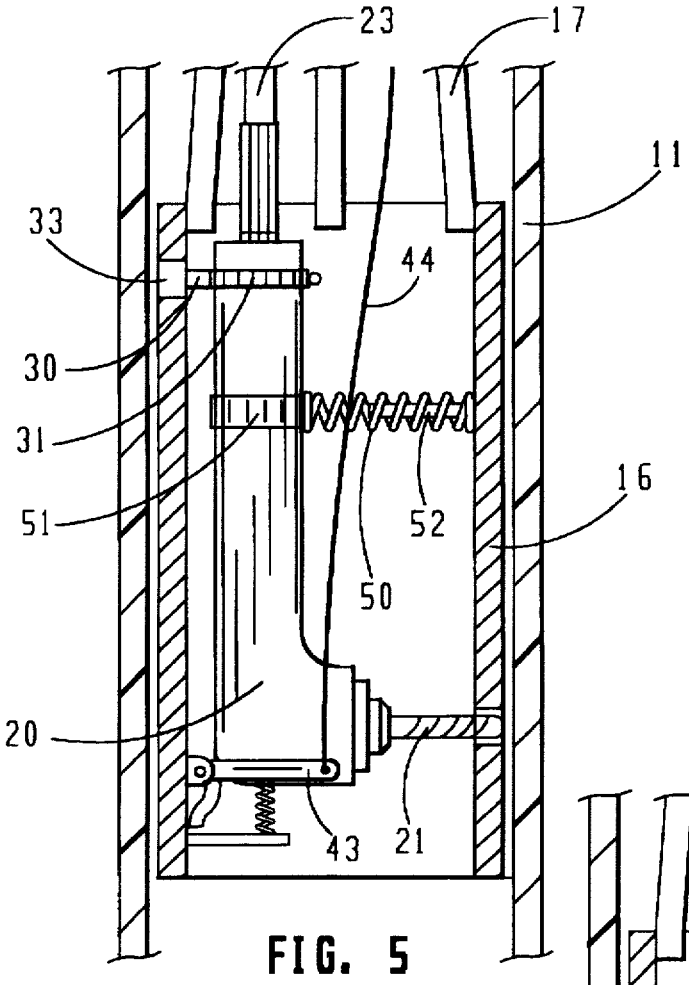
FIG. 5 is a vertical cross section of the preferred perforator drill housing showing the drill in a rest position.
Figure 6:
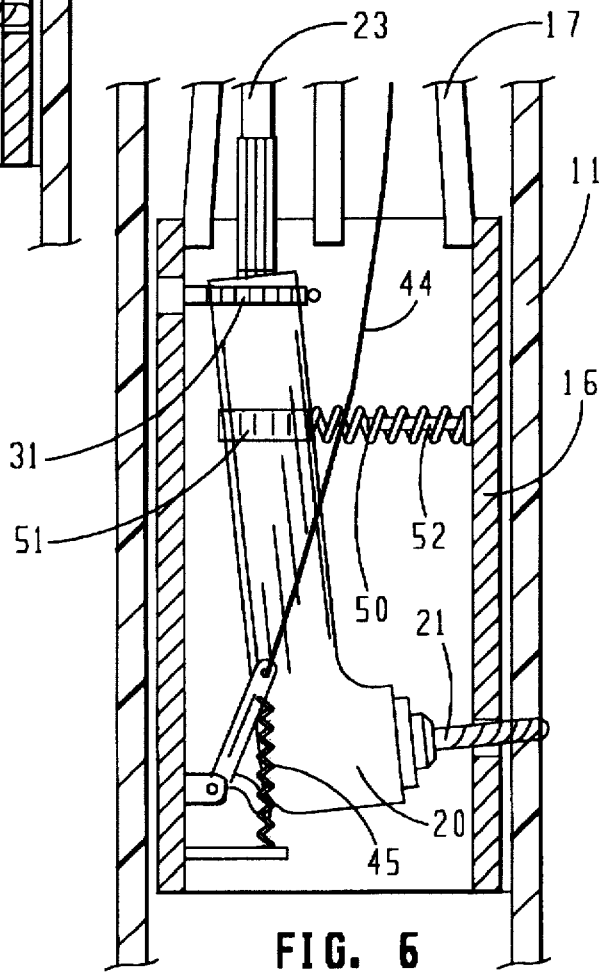
FIG. 6 is a vertical cross section of the preferred perforator drill housing showing the drill in a working position.
Figure 7:
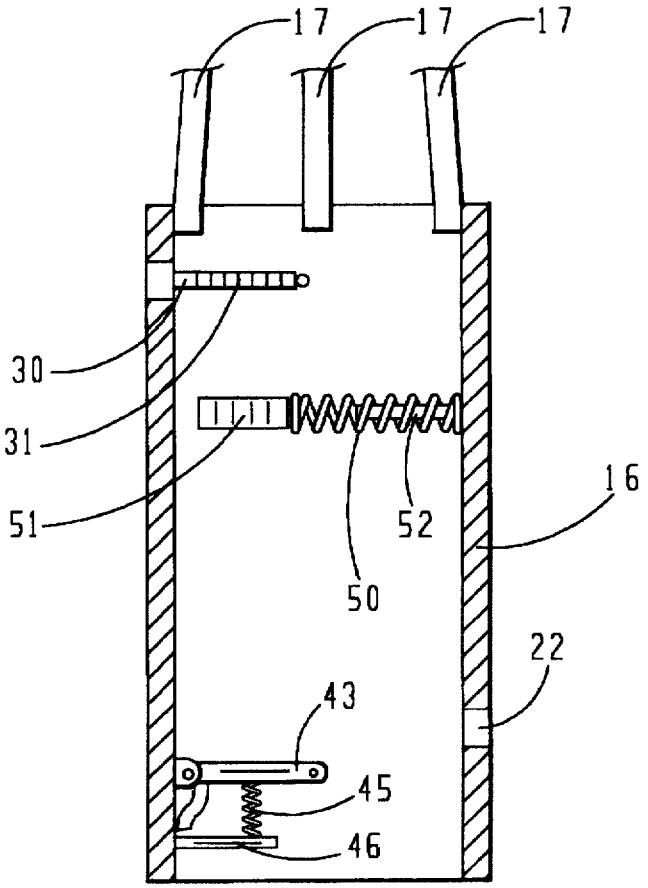
FIG. 7 is a vertical cross section of the preferred drill housing with the drill removed to show other elements within the housing.

Referring now to FIGS. 5, 6 and 7, the preferred manner for mounting the drill 20 within the housing 16 will be described. The drill 20 is mounted at a point proximate its connection to the pneumatic tubing 23 using a mounting bracket 30 and an adjustable ring clamp 31. The mounting bracket 30 is welded or otherwise securely fastened to the interior of the housing 16. The clamp 31 is fastened to the mounting bracket 30 and wraps around the end of the drill 20 as shown. The tension of the clamp 31 can be adjusted through an opening 33 in the housing 16 using a standard tool, such as a screwdriver. The clamp 31 is adjustable to accommodate different sizes of drills and to permit removal of the drill for maintenance.

FIG. 5 shows the drill 20 in its rest position and FIG. 6 shows the drill 20 in its working position. The mechanism for moving the drill between these two positions will now be described with reference to FIG. 2.

As seen in FIG. 2, the movement of the drill 20 is accomplished using a cam 40, which is rotatably mounted between end brackets 41. The end brackets 41 are secured such as by welding to the interior of the housing 16. A cam limiter 42 is secured to the cam 40 and engages the base of the drill 20 opposite the drill bit 21. The drill 20 rests on the cam limiter 42 and is moved from the rest position to the working position by rotation of the cam 40. The drill 20 can not move beyond a maximum travel point in the working position because the free end of cam limiter 42 strikes the top of the drill when the maximum travel position is reached. The cam 40 is rotated by a handle 43 attached thereto in response to a force applied by a cable 44 connected to the handle 43.

As seen in FIG. 1, the cable 44 extends out the top of the well casing 11 where an operator (not shown) pulls the cable to move the drill 20 into the working position. To prevent the cable 44 from snagging or becoming entangled with the support rods 17 or other parts of the assembly 15, a cable guide (not shown), such as a hole in the plate 18, may be provided.

A return spring 45, shown in FIG. 2, is attached to the handle 43 and to a spring anchor 46, which is fixed in place such as by welding to the interior of the housing 16. When the force on the cable 44 is released, the return spring 45 pulls the handle 43 downward, thus rotating the cam 40 back to the starting position.

Referring again to FIGS. 5, 6 and 7, a mechanism for returning the drill 20 to its rest position will be described. A compression spring 50 is attached to the drill 20 using an adjustable ring clamp 51 that fits around the drill 20. The clamp 51 is located intermediate the clamp 31 and the free end of the drill 20. The spring 50 is slidably retained in place by a post or spring guide 52, which is securely mounted to the interior of the housing 16. The length of the spring guide 52 is such that it will not interfere with the movement of the drill 20. When the force on the cable 44 is released, the spring 50 pushes the drill 20 back into the rest position as shown in FIG. 5. The spring 50 has sufficient strength to keep the drill 20 in contact with the cam limiter 42. Movement of the drill 20 back into the rest position under the force of the spring 50 stops when the free end of the cam limiter 42 comes to rest against the interior of the housing 16, as depicted in FIG. 2.

When a well of the above-described construction ceases to provide an adequate flow of water, it can often be repaired using the perforator 10 of the present invention. A log of strata produced when the original well was drilled can be extremely useful in the repair procedure.

The perforator 10 is lowered into the case casing 11 using the tube 14 as a transporting mechanism. The tube 14 is suspended from above the earth's surface by an elevator (not shown) which is part of a conventional drilling rig or pulling unit. Segments of the 1¼" diameter tube 14 are added as the drill assembly 15 is lowered gradually down the well to the level where it is expected that water is present. Successive tube segments are secured to each other by conventional threaded end connections.

After the drill assembly 15 has reached the desired depth, the hole drilling procedure begins. The compressed-air source (not shown) is started to provide power to the drill 20. The operator pulls the cable 44 to move the drill 20 from the rest position to the working position to drill a perforation in the well casing 11, as depicted in FIG. 6. The operator then releases the tension on the cable 44 and the drill 20 is returned under the force of the spring 50 to the rest position as depicted in FIG. 5.

Next, the operator rotates the drill assembly 15 through a suitable angle and drills a second perforation in the well casing 11 as described above. By way of example, the operator may rotate the drill assembly 15 through 90° successively to drill four perforations at a first level in the well. Then, the operator raises the drill assembly several inches. This can be accomplished by a hydraulic motor and conventional gears (not shown) which are part of the suspension unit or elevator. At the second level, the procedure is repeated to drill additional perforations, preferably four in number 90° apart.

Thus, in accordance with the preferred procedure, four columns of perforations can be produced in the well casing 11 by repeatedly drilling four perforations at each of successive levels vertically spaced several inches apart. It has been found that 100 perforations arranged in four columns of 25 each are often sufficient to fully restore adequate flow of water from the surrounding strata into the well casing.

Although preferred embodiments of the invention have been described in detail, it will be appreciated that various alternatives and modifications thereof are within the spirit and scope of the invention as set forth in the appended claims.

What is claimed is:

1. An apparatus for drilling perforations in well casings, comprising:

a drill assembly;

transporting means secured to the top end of the drill assembly for lowering the drill assembly down to selected locations within a well casing;

a drill mounted in the drill assembly, the drill being movable between a rest position and a working position for drilling perforations through the well casing at selected locations; and positioning means connected to the drill assembly and extending out the top of the well casing for moving the drill between the rest position and the working position by an operator above the earth's surface, wherein the positioning means comprises cam means mounted in the housing and a cable connected to the cam means to rotate the cam to force the drill into the working position.

2. The apparatus of claim 1 wherein the positioning means further includes means mounted in the housing for resiliently returning the drill to the rest position when tension is removed from the cable.

3. A perforator for use in repairing a water well, comprising:

a pneumatic drill for operating a drill bit to drill perforations in a well casing;

a housing containing the drill, the housing having a port through a wall thereof to permit passage of the free end of the drill bit;

means within the housing for supporting the drill and moving the drill from a rest position to a working position, whereby the drill bit may be selectively extended through the port to drill a hole through the well casing;

means for providing compressed air to the drill from a source above the surface of the earth; and positioning means for remotely controlling the movement of the drill between the rest position and the working position by an operator above the surface of the earth, wherein the drill supporting and moving means comprises a cam rotatably supported within the housing and in contact with the drill, and a cam handle attached to the cam and connected to the positioning means.

4. A perforator for drilling holes in a well casing installed in a well, comprising:

a drill assembly positionable at selected depths within the well casing;

a pneumatic drill mounted in the drill assembly and moveable from a rest position to a working position within the drill assembly under remote control by an operator to drill holes at selected locations through the well casing;

a cam mechanism rotatably mounted in the drill assembly and abutting the drill; and an actuator attached to the cam mechanism and operable from above the earth's surface to rotate the cam mechanism and move the drill from the rest position to the working position.

5. The perforator of claim 4 further comprising a spring mounted in the drill assembly and exerting a force on the drill to return the drill to the rest position after drilling a hole in the well casing.

6. The perforator of claim 4 wherein the cam mechanism includes a cam and a cam limiter attached thereto, the cam limiter engaging the base of the drill opposite the drill bit, whereby the cam limiter forces the drill into the working position upon rotation of the cam by the actuator.

7. The perforator of claim 6 wherein the actuator includes a handle attached to the cam and a cable attached to the handle, the cable extending out the top of the well casing, whereby a force applied to the cable acts on the handle and rotates the cam.

* * * * *